US005477799A

United States Patent [19]

Kunstadt

[11] Patent Number: 5,477,799

[45] Date of Patent: Dec. 26, 1995

[54] UNSTAYED SAIL WITH RELEASABLY ENGAGEABLE LUFF AND LEECH

[76] Inventor: Robert M. Kunstadt, 470 W. End #4G, New York, N.Y. 10024

[21] Appl. No.: 294,492

[22] Filed: Aug. 23, 1994

[51] Int. Cl.[6] ..... B63H 9/04

[52] U.S. Cl. ..... 114/104

[58] Field of Search ..... 114/103, 104, 114/105, 102

[56] References Cited

U.S. PATENT DOCUMENTS

| | | | |
|---|---|---|---|
| 2,595,110 | 4/1952 | Stuebe | 114/104 |
| 3,157,149 | 11/1964 | Manchester | 114/104 |
| 3,269,343 | 8/1966 | Manchester, Jr. | 114/104 |
| 3,828,712 | 8/1974 | Mintey | 114/104 |
| 4,766,832 | 8/1988 | Dailey | 114/103 |
| 4,831,949 | 5/1989 | Valiant | 114/104 |
| 4,879,961 | 11/1989 | Aguilera | 114/102 |
| 4,967,680 | 11/1990 | Dailey et al. | 114/103 X |

*Primary Examiner*—Sherman Basinger

[57] ABSTRACT

An unstayed sail for a water craft, such as a spinnaker, is provided with tapes along its luff and leech, which can be brought into contact with each other, for releasable engagement, solely by finger pressure. This permits the spinnaker to be prepared for easy hoisting in a short time, even under difficult conditions of rough seas and little or no light. On hoisting the spinnaker, the sheet and guy are pulled apart in order to separate the tapes and permit the spinnaker to fill with wind in a controlled manner, from foot to head.

8 Claims, 2 Drawing Sheets

UNSTAYED SAIL WITH RELEASABLY ENGAGEABLE LUFF AND LEECH

FIELD OF THE INVENTION

This invention relates to the field of sails for propulsion of water craft, in which the luff of the sail is not supported by any stay, i.e., the sail is free-flying. A spinnaker is such a sail.

PRIOR ART

As explained in detail in U.S. Pat. No. 3,157,149 (cols. 1–2), a spinnaker is a difficult sail to set because it is not attached to a forestay. It therefore has a tendency to wrap around itself, and get stuck in an hourglass shape, refusing to open properly. To avoid this, various methods have been developed, such as the time-honored breakable stops of yarn; furling bags with pop-open VELCRO edges (U.S. Pat. No. 3,828,712); and integral pop-open furling pockets in the sail itself (U.S Pat. No. 3,157,149).

These known methods suffer from various disadvantages. Yarn stops must be carefully knotted by hand around the spinnaker, each spaced a few feet apart. This is not the simplest task on a pitching boat, and even under the best conditions it takes several minutes to accomplish. If the sail is not properly arranged before the stops are applied, then it will not open correctly.

A method using a furling bag, even a pop-open bag, also requires that no error be made in placing the sail in the bag. Additionally, such a bag is an extra piece of equipment that can get lost overboard if care is not taken.

A method using an integral furling pocket can be more desirable, but the known method of U.S. Pat. No. 3,157,149 involves the application of at least one fastener means spaced away from the luff of the sail, or even two such means placed right down the middle of the sail. This could have a tendency to interfere unnecessarily with laminar airflow over the sail panels, with a resulting degradation in performance. Moreover, since the fastener means according to that patent are spaced apart from each other by only about the circumference of the furled sail in order to create a furling pocket, the sail must be carefully gathered and placed within the furling pocket established by such relatively closely-spaced fastener means. This could take time to accomplish neatly, and could be difficult to do in the dark when the location of the pocket boundaries and the sail portions to be laid in it are hard to see. In a sailboat race, which can be won or lost by seconds, unnecessary wasted time is to be avoided.

SUMMARY OF THE INVENTION

In the present invention, a stayless sail such as a spinnaker can be prepared for hoisting in a brief moment, simply by running one's hand down the sail. This permits assurance that the sail will hoist without a wrap, while taking minimal time. Indeed, the task can be accomplished entirely by feel, on a dark and stormy night (many races are held at night).

This is accomplished by providing releasable tapes, that can be secured solely be hand pressure without tools or other supplementary accessories, along the inside of both the luff and leech of the sail to be hoisted. Starting at the head of the sail, the tapes are brought together by hand pressure to prepare the sail for hoisting. This provides assurance that the luff and leech are not twisted, and holds them together as the sail is hoisted, so that the sail cannot fill with wind prematurely. The sail is then broken out when desired by pulling on the guy and sheet, to separate the releasable tapes.

DETAILED DESCRIPTION OF THE INVENTION

Referring now to FIGS. 1–5, the invention will now be described in detail.

Figure 1:
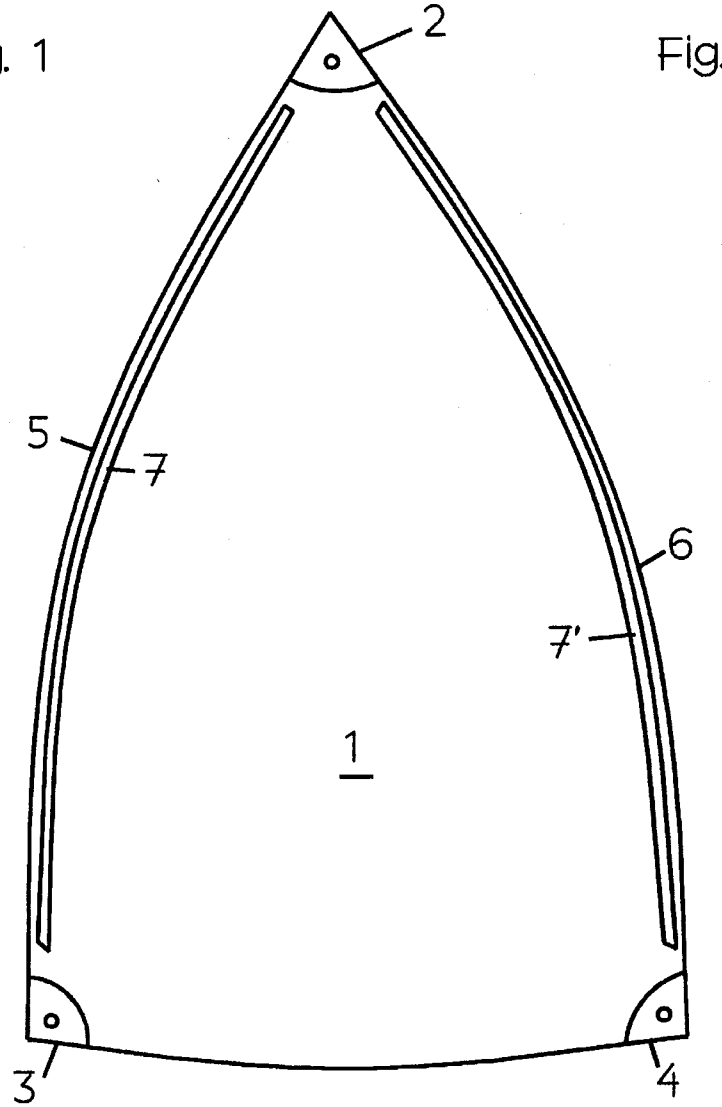
FIG. 1 is a rear elevation of a spinnaker according to the invention.

FIG. 1 shows spinnaker 1 having head 2, tack 3, clew 4, luff 5 and leech 6 (it is assumed that the wind is coming from left to right in all figures, for purposes of this explanation; the skilled person will appreciate that a spinnaker is often symmetrical, so that the tack and clew—and luff and leech—are renamed as the boat jibes before the wind). Affixed to spinnaker 1 by any convenient and durable means, such as thread, heat sealing or adhesive, are tapes 7, 7'. Tapes 7, 7' extend substantially the height of spinnaker 1, along its expected windward side (i.e., the aft side); and substantially along luff 5 and leech 6, rather than spacedly therefrom. Tapes 7, 7' are of a material that permits respective tapes 7, 7' to engage each other merely upon hand pressure from a crew member. They may be color-coded red and green for port and starboard, as is usual on a spinnaker.

Figure 2:
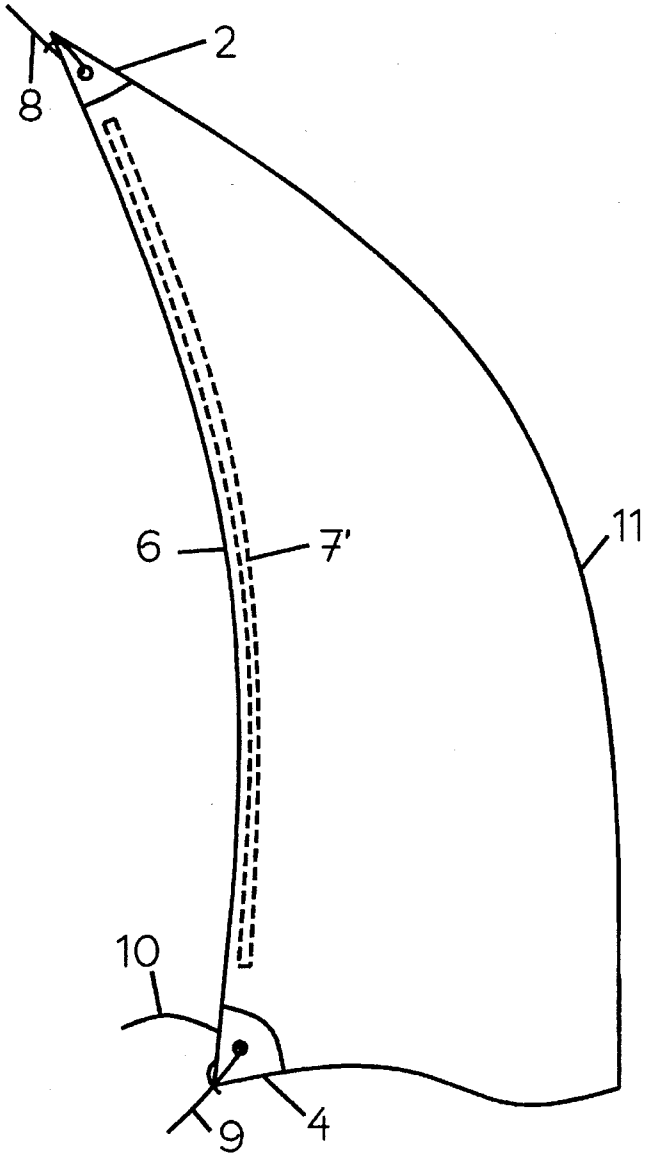
FIG. 2 is a side elevation of a spinnaker according to the invention, which has just been hoisted but is not yet broken out.

FIG. 2 shows spinnaker 1 in process of hoisting. Head 2 is attached to halyard 8 by any convenient means, such as a swivel snapshackle. Sheet 9 is similarly affixed to clew 4, and guy 10 to tack 3 (not visible). Tapes 7, 7' engage each other to keep spinnaker 1 from opening prematurely. Spinnaker 1 now flys like a flag, with luff 5 (not visible) and leech 6 held together upwind, and belly 11 downwind. Any twists that may have been made in spinnaker 1 in the course of hoisting, therefore will tend to be pulled out by the wind, just as a flag tends to fly with the wind.

Figure 3:
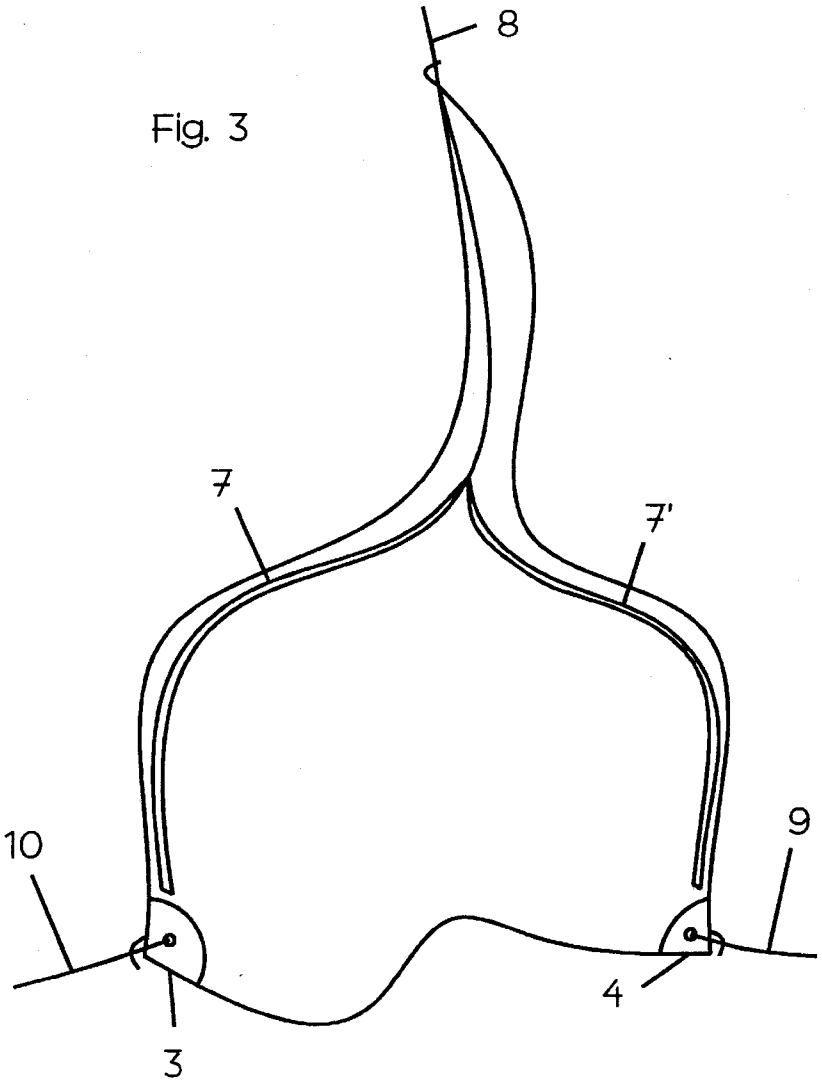
FIG. 3 is a rear elevation of a spinnaker according to the invention, in the process of being broken out.

FIG. 3 shows spinnaker 1 in the process of being broken out. A crew member pulls on guy 10 and sheet 11, pulling apart tack 3 and clew 4. Spinnaker 1 thereupon evenly fills with wind from foot to head, as tapes 7, 7' release from each other, without any chance for an hourglass wrap to develop.

Figure 4:
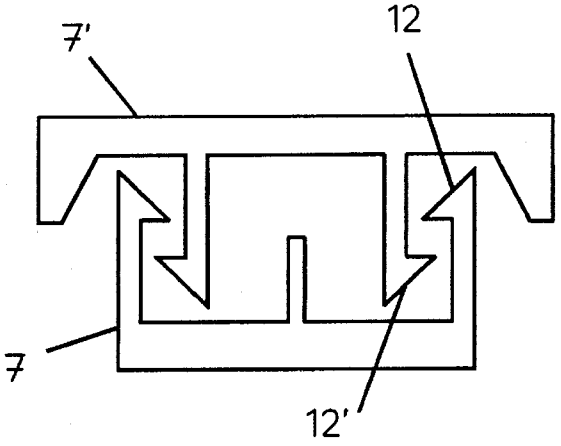
FIG. 4 is a cross-section of a releasable tape according to a first embodiment of the invention.

Referring now to FIG. 4, one embodiment of tapes 7, 7' is shown, in which they comprise plastic extrusions having projections 12, 12' that releasably engage upon application of hand pressure. Such construction is like that used in plastic food-storage bags (ZIP-LOC brand bags).

Figure 5:
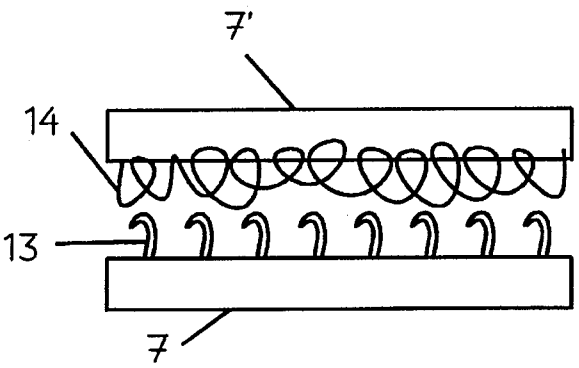
FIG. 5 is a cross-section of a releasable tape according to a second embodiment of the invention.

Referring now to FIG. 5, another embodiment of tapes 7, 7' is shown. In this instance, hooks 13 are provided to engage loops 14. Such construction is like that used in VELCRO brand hook and loop tape.

In operation, unfurled spinnaker 1 is laid on deck. Spinnaker 1 need not be laid out particularly neatly, it can be bunched up. Head 2 is located, by feel if necessary. Starting at head 2, the crew runs his or her hand down and along the edges of the sail (luff 5 and leech 6), bringing them together and engaging them by means of tapes 7, 7'. It will be appreciated that this takes no special care and little time, and can easily be done in conditions of little or no visibility, such as night-time and storms, since tapes 7, 7' can be located by feel. No tools or other accessories, such as stowage bags, are needed.

The invention is not limited to the exact embodiments shown, and may be realized in such other ways as will be apparent to the skilled artisan, utilizing the teachings of the invention.

I claim:

1. An unstayed sail for a water craft, said sail having a luff and a leech; said luff being provided with a first fastening means extending substantially along its length, and said leech being provided with a second fastening means extending substantially along its length; said first and second fastening means being pressure-sensitive engagement means; and said first and said second fastening means being releasably engageable to each other by human digital pressure.

2. A sail according to claim 1, said first and said second fastening means comprising strips of hook and loop tape.

3. A sail according to claim 1, said first and said second fastening means comprising plastic extrusions provided with releasably interlockable projections.

4. A sail according to claim 1, said first and said second fastening means being color-coded for port and starboard.

5. A sail according to claim 1, said sail being a spinnaker.

6. A sail according to claim 5, said first and said second fastening means comprising strips of hook and loop tape.

7. A sail according to claim 5, said first and said second fastening means comprising plastic extrusions provided with releasably interlockable projections.

8. A sail according to claim 5, said first and said second fastening means being color-coded for port and starboard.

* * * * *